US011533973B2

(12) United States Patent
Estrada

(10) Patent No.: US 11,533,973 B2
(45) Date of Patent: Dec. 27, 2022

(54) SELF-CONFIGURING BAG

(71) Applicant: Roxana Estrada, San Marcos, CA (US)

(72) Inventor: Roxana Estrada, San Marcos, CA (US)

( * ) Notice: Subject to any disclaimer, the term of this patent is extended or adjusted under 35 U.S.C. 154(b) by 138 days.

(21) Appl. No.: 17/006,612

(22) Filed: Aug. 28, 2020

(65) Prior Publication Data

US 2021/0059368 A1 Mar. 4, 2021

Related U.S. Application Data

(60) Provisional application No. 62/892,818, filed on Aug. 28, 2019.

(51) Int. Cl.

| | |
|---|---|
| ***A45C 7/00*** | (2006.01) |
| ***A45C 13/10*** | (2006.01) |
| ***A45C 3/00*** | (2006.01) |

(52) U.S. Cl.

CPC ..... *A45C 7/0059* (2013.01); *A45C 3/00* (2013.01); *A45C 13/1046* (2013.01); *A45C 2007/0004* (2013.01)

(58) Field of Classification Search

CPC ..... A45C 7/0059; A45C 3/00; A45C 13/1046; A45C 2007/0004

USPC ..... 383/6

See application file for complete search history.

(56) References Cited

U.S. PATENT DOCUMENTS 977,129 A * 11/1910 Reynolds ..... A47K 3/022 4/585
1,629,723 A * 5/1927 Moler ..... A47J 47/18 604/262
1,688,288 A * 10/1928 Rogers ..... A47J 36/06 383/4
3,475,767 A * 11/1969 Friesen ..... A61G 9/006 4/144.2
4,337,812 A * 7/1982 Trinkner ..... A45F 4/02 206/541
D291,133 S * 7/1987 Disanza ..... D34/1
4,738,545 A * 4/1988 Westgor ..... A45C 3/10 472/137
4,794,029 A * 12/1988 Tennant ..... A47G 9/062 428/101
D299,979 S * 2/1989 Garrison ..... D34/1
4,856,912 A * 8/1989 Damus ..... A45F 4/02 33/270
4,938,607 A * 7/1990 Kelley ..... B65D 31/00 383/4
4,955,068 A * 9/1990 Tennihan ..... B65B 67/12 52/165
4,991,978 A * 2/1991 Ostrowski ..... A45F 4/02 383/4
5,069,554 A * 12/1991 Bonnett ..... A47G 11/003 53/413
5,092,681 A * 3/1992 Ashley, III ..... B65D 33/28 383/4
5,187,823 A * 2/1993 Ferguson ..... A45F 4/06 383/4

(Continued)

*Primary Examiner* — Peter N Helvey
(74) *Attorney, Agent, or Firm* — Donn K. Harms

(57) ABSTRACT

A self-configuring bag device formed of flexible material is configured for easy folding and storage while in a first position, and to operate as a bag to carry objects within an interior cavity in a bag configuration. Changing between the first position and bag configuration is accomplished by pulling upon first and second portions of a flexible member slidably positioned within a channel running around the perimeter edge of the body.

7 Claims, 4 Drawing Sheets

(56) References Cited

U.S. PATENT DOCUMENTS

| | | | | | |
|---|---|---|---|---|---|
| 5,195,828 | A * | 3/1993 | Bush-Rodriquez | A45C 9/00 | 383/4 |
| D341,934 | S * | 12/1993 | Abraham | D3/276 | |
| RE34,849 | E * | 2/1995 | Sanders | B65F 1/0006 | 383/7 |
| 5,417,462 | A * | 5/1995 | Hensley | A01G 20/40 | 294/212 |
| 5,419,564 | A * | 5/1995 | Lamle | A63F 3/00094 | 273/286 |
| 5,482,374 | A * | 1/1996 | Buhyoff | A45C 9/00 | 383/4 |
| 5,529,395 | A * | 6/1996 | French | B65D 65/08 | 383/118 |
| 5,693,398 | A * | 12/1997 | Granger | A45C 3/10 | 428/101 |
| 5,819,343 | A * | 10/1998 | Zampirri, Jr. | A47G 9/062 | 5/418 |
| 5,895,118 | A * | 4/1999 | Hensley | A45C 9/00 | 383/117 |
| 5,971,611 | A * | 10/1999 | Rosengren | A45C 9/00 | 383/14 |
| D421,521 | S * | 3/2000 | Howard | D3/201 | |
| 6,176,356 | B1 * | 1/2001 | Powley | A45C 9/00 | 5/655 |
| D482,224 | S * | 11/2003 | DeCet | D6/608 | |
| D523,636 | S * | 6/2006 | Wilmink | D3/303 | |
| 2006/0008182 | A1 * | 1/2006 | Ingraselino | B65F 1/0006 | 383/4 |
| 2011/0042428 | A1 * | 2/2011 | Ranciato | A47G 9/062 | 224/156 |
| 2012/0128268 | A1 * | 5/2012 | Fazackerley | A45C 13/1046 | 383/4 |

* cited by examiner

SELF-CONFIGURING BAG

This application claims priority to U.S. Provisional Patent Application Ser. No. 62/892,818 filed on Aug. 28, 2019, which is incorporated herein in its entirety by this reference thereto.

BACKGROUND OF THE INVENTION

1. Field of the Invention

The present invention relates to bags and satchels employed to carry items such as groceries or purchased products. More particularly, the invention relates to a self-configuring bag or sack-like container which has a compact planar stored configuration, and which is configured for positioning items to be carried thereon, whereupon it will automatically form a carrying bag surrounding the items.

2. Prior Art

For as long as there have been items to gather or buy there have been satchels or bag containers in which to carry them. Conventional shopping bags generally have a sidewall forming an interior cavity therein. One or a plurality of handles may extend from the sidewalls to allow a handle carrying of the loaded bag.

Because of the proclivity of many plastic and paper bags employed by stores and vendors for carrying products to end up in landfills or waterways, many states in the U.S. and an increasing number of foreign countries have initiated bag-limiting measures to reduce the number of such bags used. Consequently, customers can be denied by the vendors and retailers of the convenience of a free carrying bag for their purchases. If not denied, a large number of retailers and vendors are required by law to charge a fee for each bag used by each customer. As a consequence of such actions, many consumers are left with the choice of continually purchasing bags on every trip to a store, or bringing their own bag.

An additional problem exists in positioning large and bulky items in conventional preformed paper and plastic bags. If such items are heavy, they must be elevated and then lowered into a bag container with great effort in both directions. Further, even where a bulky item is light weight, the items are more frequently positioned in oversized bags due to the need to position them through the opening of the bag container surrounded by sidewalls.

The forgoing examples of related art in the field of bag containers and limitations related therewith are intended to be illustrative and not exclusive, and they do not imply any limitations on the self configuring bag device herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art of bag type containers for carrying items. It achieves the above noted goals through the provision of a self-configuring handled-bag container, which stores in a very compact configuration. From this compact stored configuration, the device is easily deployed for positioning of products to be carried thereon, upon a planar-configured surface. Thereafter, the bag device will automatically form a bag or satchel having a sizeconforming interior cavity which conforms to the size and volume of the products placed upon it.

In operation, the bag device herein is formed of a substantially planar and rectangular body which is formed of flexible fabric material. By fabric and/or material herein is meant, any woven, knitted, unwoven, or other flexible material. The body has handles extending from opposing side edges of the body. While it could be formed in other shapes such as circular or oval, currently a square configuration or rectangle configuration having opposing side edges, which are substantially the same length, works well for self configuration around a wide variety of objects to be carried.

The body of the device, once removed from a stowed configuration such as folded upon itself in storage, is positionable to a first position, with a first surface of the body in contact upon a planar support surface such as a counter top or floor or the like. So positioned in this first position, the body of the device is ready to receive objects for bagged transport by the bag device. With the body positioned in this first position which is substantially planar, the user will position one or a plurality of objects to be carried, upon a second surface of the body which is opposite the first surface, and located within the perimeter edge of the body.

With the products to be carried positioned on the second surface and the body on the support surface, the user thereafter pulls an elongated flexible member, such as a twine, rope or cable, which has two portions protruding through respective grommets and each projecting above the second surface. The flexible member is located within and follows a defined pathway running in formed channels along portions of the perimeter edge of the body and across diagonal sections communicating between the channels.

A pulling of the protruding portions of the flexible member by the user, with the body in the first position, causes the overall length of the flexible member located within the channels to shorten. The elongated protruding portions of the flexible member may be knotted or tied or have a connector engaged thereto, to thereby prevent them from sliding into the channels.

This shortening of the flexible member portion located within the channels and across the diagonal sections connecting the channels, causes an accordion fold of the material forming the channels, or a folding thereof into pleats, thereby shortening the overall length of the channels around the perimeter edge of the body.

The accordion fold imparted by the pulling of the flexible member, in turn, causes the body to form a continuous sidewall around the second surface thereof on which the goods are positioned. This formed sidewall forms and surrounds an interior cavity which during the pulling of the cable will self-size to a size and volume sufficient to tightly hold the positioned products therein.

The two portions of the flexible member, which protrude from locations along the perimeter edge of the body, are respectively located in a center area of the perimeter edge located between two ends of a respective handle engaged to opposing sides of the body. The pulling of the flexible member to form the sack or satchel, concurrently positions each of the two handles on opposite sides of the cavity, on a now raised edge of the formed bag. This is preferred as it automatically positions the handles in positions ready to be gripped to lift and carry the formed bag. Further, the interior cavity is sized to restrain whatever sized articles are held in the interior cavity.

To reverse the process, once the bag device and its contents have reached a destination, the user will position the first side of the body on a support surface. Thereafter, they will release the restraint holding the protruding portions from returning into the formed interior channels. This allows the formed sidewalls of the body of the bag container to return from the accordion folded configuration, to a substantially planar configuration. Thereafter the articles carried can be removed from the second side of the body, and the device can be folded and stored.

With respect to the above description, before explaining at least one preferred embodiment of the herein disclosed self-configuring bag device in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other self-configuring bag devices and for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Finally, unless provided with a specific different respective definition, the term "substantially" herein, means plus or minus five percent.

It is an object of this invention to provide a bag device for carrying articles, which is planar and compact in a stored configuration and is also easily engaged around a wide variety of products of widely varying dimensions.

It is a further object of the invention to make the bag device reusable to aid in the movement to use less plastic and paper bags.

It is an additional object of this invention to provide such a bag device which in a first position is planar so articles for carrying may be stacked upon it, and which is easily changed to a bag configuration thereafter which has an interior cavity adapted in size and volume to securely hold the objects therein.

These and other objects of the bag invention will be brought out in the following part of the specification, wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting.

In the drawings:

FIG. 1 is an overhead view of the flexible body of the bag device herein in a first position, showing the first surface positioned upon on a support surface, and showing handles extending from opposite side edges, and showing a defined pathway through a channel running around the perimeter edge for positioning of a flexible member therein which is used to actuate the body to form a bag.

FIG. 2 depicts an overhead view of the second side of the body of the bag, opposite that of FIG. 1, and showing projecting portions of the flexible member, extending through apertures in the body aligned with interior channels, and also showing an enlarged sectional view of the interior and exterior aligned grommets forming a path for the projecting portion extending from the formed channel in the body.

DETAILED DESCRIPTION OF THE PREFERRED

Embodiments of the Invention

Figure 1:
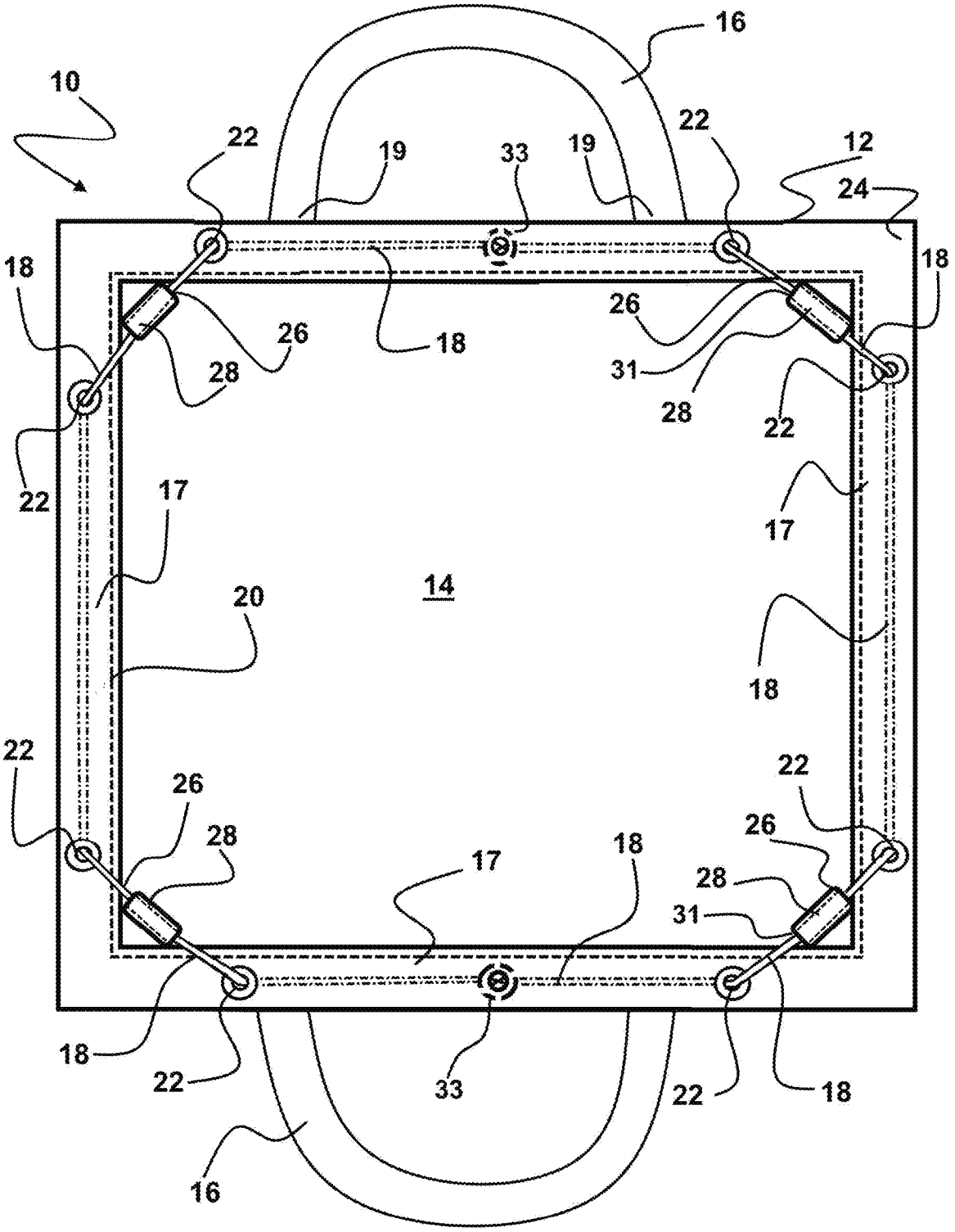

In this description, the directional prepositions of up, upwardly, down, downwardly, front, back, top, upper, bottom, lower, left, right and other such terms refer to the device as it is oriented and appears in the drawings and are used for convenience only. They are not intended to be limiting or to imply that the device has to be used or positioned in any particular orientation.

Now referring to drawings in FIGS. 1-5, wherein similar components are identified by like reference numerals, there is seen in FIG. 1 an overhead view of the bag or carrying device 10 herein, showing the body 12 which currently is preferred in a square or substantially equal-sided rectangle but could be other shapes such as a circle. While a circular shape was considered, unexpectedly, the rectangle shape performed better to more easily accordion fold and form a bag or satchel, once the diagonal section 26 of the flexible member 18 was positioned at each of the four corners 24 of the body.

Figure 2:
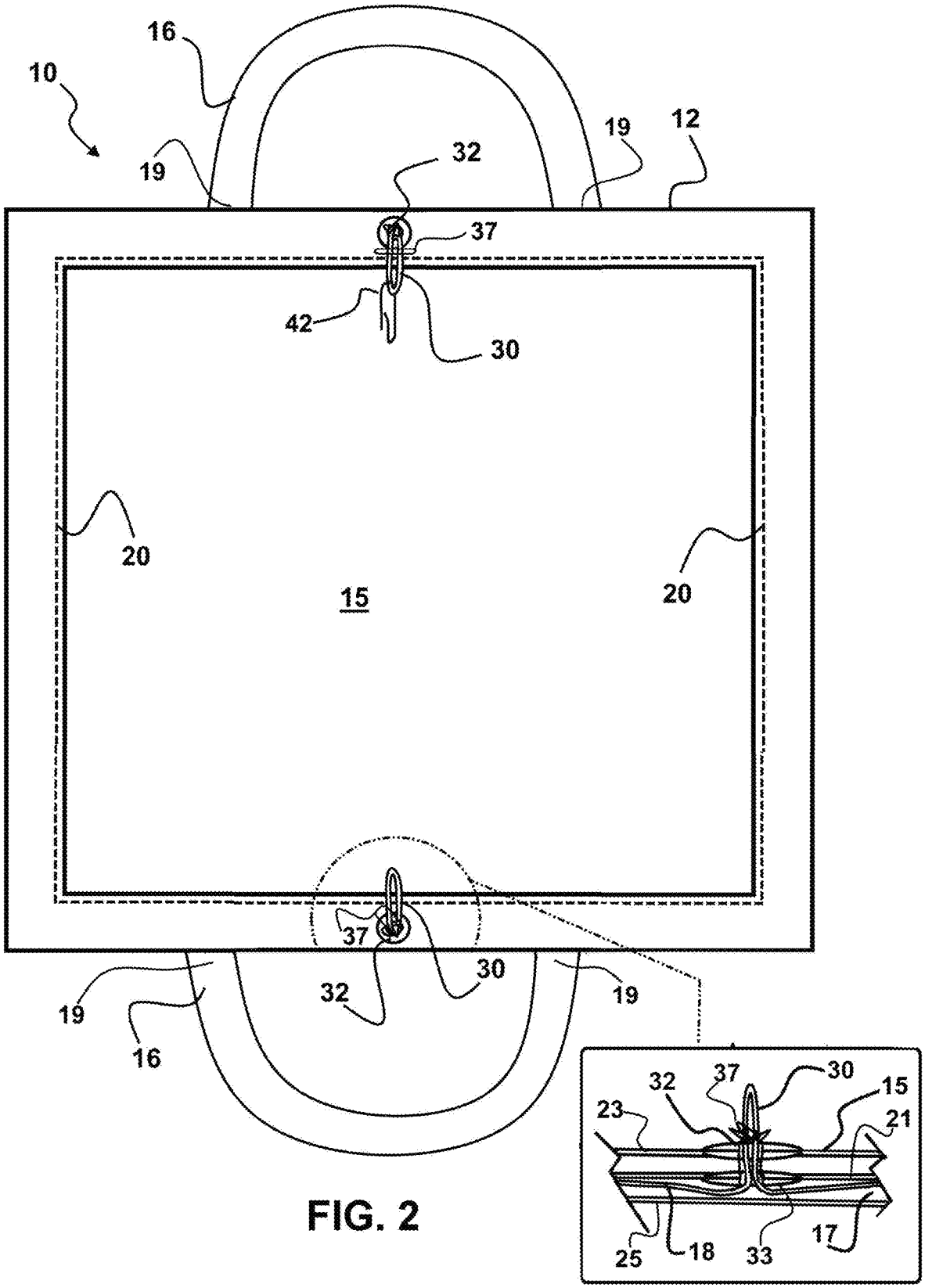
Figure 4:
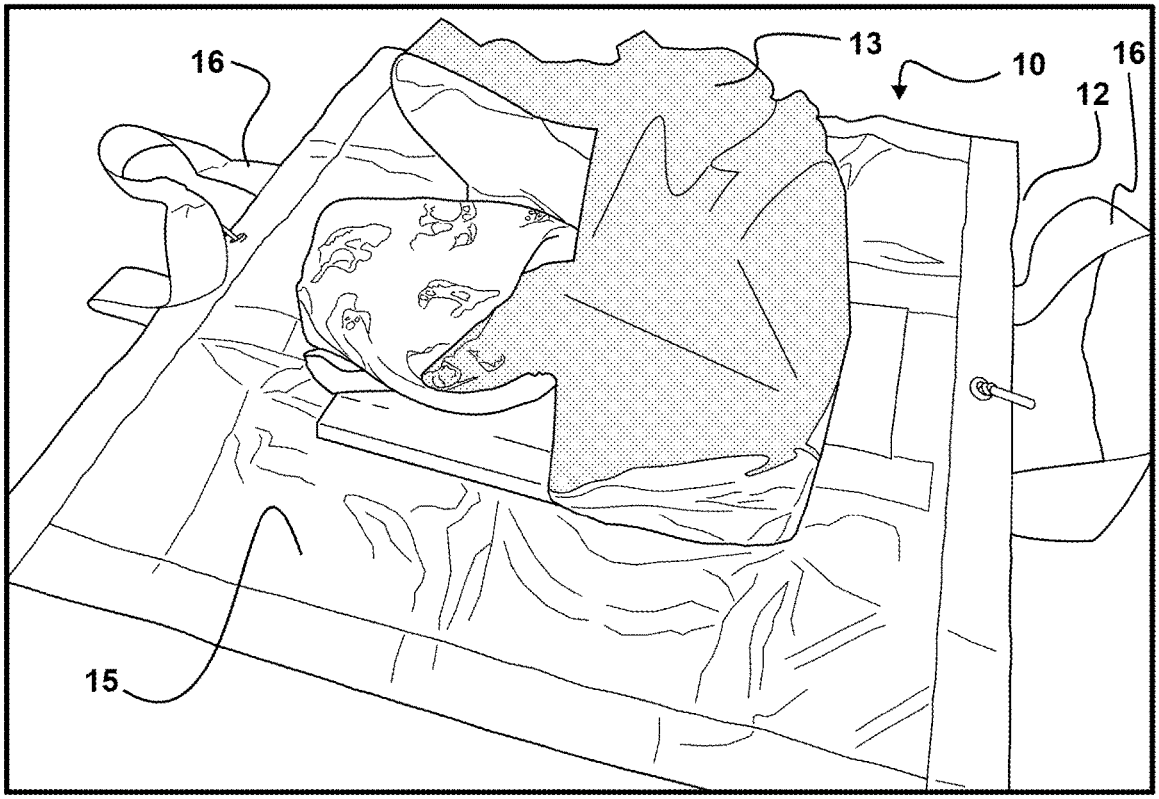
FIG. 4 shows articles to be carried positioned on the second surface of the body of the bag within the perimeter edge thereof.

As shown in FIGS. 1-2, the first surface 14 of the body 12 is configured for positioning on a support surface, such as a counter or floor or the like, when the bag device 10 is located thereon, to self configure to carry articles 13 (FIG. 4). Also shown in FIG. 1 are handles 16 which have each of two handle ends 19, engaged at or adjacent edges of the body 12 on opposing sides thereof. The handles 16, so engaged, will project away from opposing side edges of the body 12 of the device 10, but, if formed of flexible material, may be folded over the first surface 14 or second surface 15 of the body 12.

Channels 17 are formed around the perimeter of the body 12. The channels 17 run substantially parallel to each side edge of the body 12. Such channels 17 may be formed by hemming the material forming the body 12 such as by sewing 20 or by ultrasonic welding or adhesive, which holds a portion of each side edge folded against the body 12. In a particularly preferred mode of the device 10 having an interior opening 33, during formation of the channels 17 by sewing or other means, the central layer 21 (FIG. 2) of material is positioned within the channels 17 located between a first fabric layer 23 and a second fabric layer 25.

This central layer 21 is positionable within the channels 17, for example, by a double-fold hemming where the central layer 21 is folded along the edge, and then the edge is folded again and sewn. This central layer 21 as shown for example in the enlarged window of FIG. 2, is preferred, because it increases the tear resistance of the perimeter edges of the body 12, and because in a particularly preferred mode of the device 10, it provides a mount for an interior opening 33 which aligns with a central opening 32.

As shown, the central opening 32 is formed into the first layer 23 of flexible fabric or material forming the channels 17. The interior opening 33 is formed in the central layer 21 of material positioned within the channels 17 in-between the first layer 23 and the second layer 25. Both the central opening 32 and the interior opening 33, may both be reinforced with metal or polymeric supports such as grommets, eyelets, or other engageable components which have an opening surrounded by a metal or polymeric shoulder portion, which is a well known configuration for eyelets and grommets and the like.

As shown in FIGS. 1 and 2, additional secondary openings 22 are formed through one of the first layer 23 or second layer 25 of the flexible material forming each channel 17. As shown and preferred, each of the secondary openings 22 communicate through first layer 23 of material forming the channel 17 and communicates with first side 14 of the body 12. However, the secondary openings adjacent each corner of the body 12, may also communicate between the channel 17 and the second side 15 of the body 12.

As shown and preferred to more easily cinch the flexible member 18 and form the accordion folding of the four sides of the body 12, pairs of openings 22 are positioned on the body 12 with one such pair of openings 22 located adjacent each of four corners 24 of the body 12. Each pair of openings 22 at each corner 24, forms a diagonal portion 26 of the flexible member 18 which is slidably positioned within the channels 17 running around the circumference of the body 12. Thus each of a first, second, third, and fourth diagonal portion 26, communicates the flexible member 18 from a channel 17 formed on one edge of the body 12 to a channel 17 formed on an adjacent edge of the body 12.

As shown, the body 12 has a circumferential pathway formed for the flexible member 18 through respective channels 17 which are formed around the perimeter of the body 12. This circumferential pathway includes four portions of the flexible member 18 are each positioned within a respective channel 17, and four portions of the flexible member 18 communicating between adjacent channels 17 at diagonal sections 26.

Covers 28 which are open on both ends, are preferably engaged to the body 12, and form diagonal passages 31 through which the diagonal sections 26 slidably communicate. While the device 10 will perform well without them, these covers 28 are preferred as testing shows a pulling of the projecting portions (FIG. 2) of the flexible member 18 to shorten it while contained within the pathways 17, operates much easier with the covers 28 holding the diagonal sections 26 in their respective diagonal passages 31 formed by the covers 28.

In FIG. 2 is shown the body 12 of the device 10 and showing the second surface 15 of the body 12 opposite the first surface 14 in FIG. 1. As shown the handles 16 both project from opposite edges of the rectangular perimeter of the body 12.

Also shown are the projecting portions 30 of the flexible member 18, communicating through central openings 32. These central openings 32 which, as noted, may be reinforced, provide a path for the projecting portions 30 of the flexible member 18 from the channels 17 formed between the first layer 23 and second layer 25 of flexible material or fabric, fabric forming the body 12 and the channels 17. As shown, the projecting portions 30 may be held in this projecting position by restraints 37 which engage upon or are formed into the flexible member 18 forming the projecting portions 30. Such restraints 37 will have a diameter larger than that of the central openings 32. Such restraints 37, for example, may be a knot formed in the flexible member 18, or a compressed ring, or a swag, or another restraint 37 which will engage the flexible member 18, As shown in the enlarged sectional view of the central openings 32 of FIG. 2, the projecting portions 30 of the flexible member 18, communicate through the central openings 32 and are held slightly projecting by a by the restraint 37, located on each projecting portion 30 which is sized slightly larger than a diameter of each central opening 32. This permanently positions the projecting portions 30 in respective locations allowing the user to pull the projecting portions 30, to reduce the length of the flexible member 18 within the channels 17, to actuate the device 10 to form a bag as in FIG. 4. As noted, shortening the length of the flexible member 18, will form accordion folds along the perimeter edge of the body 12, which will form sidewalls as in FIG. 5.

Figure 3:
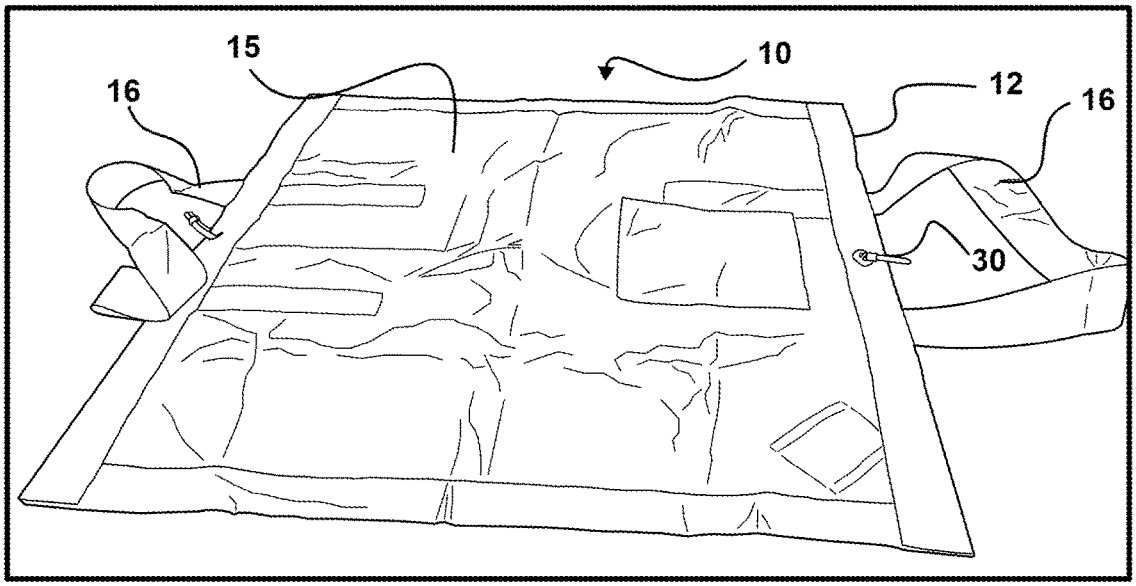
FIG. 3 shows the bag device positioned for use with a first surface of the body of the bag upon a support surface and the projecting portions of the flexible member extending above the second surface from interior channels.

FIG. 3 shows the bag device 10 positioned for use with the first surface 14 of the body 12 upon a support surface. Also shown are the projecting portions 30 of the flexible member 18 extending above the second surface 15 from interior channels 17. As noted the projecting portions 30 are subsequently pulled, to actuate the body to form a bag configuration as in FIG. 5.

In FIG. 4 is shown articles 13 to be carried by the device 10, positioned on the second surface 15 of the body 12 of the bag device 10. They are preferably located within the perimeter edge of the rectangular body 12.

Figure 5:
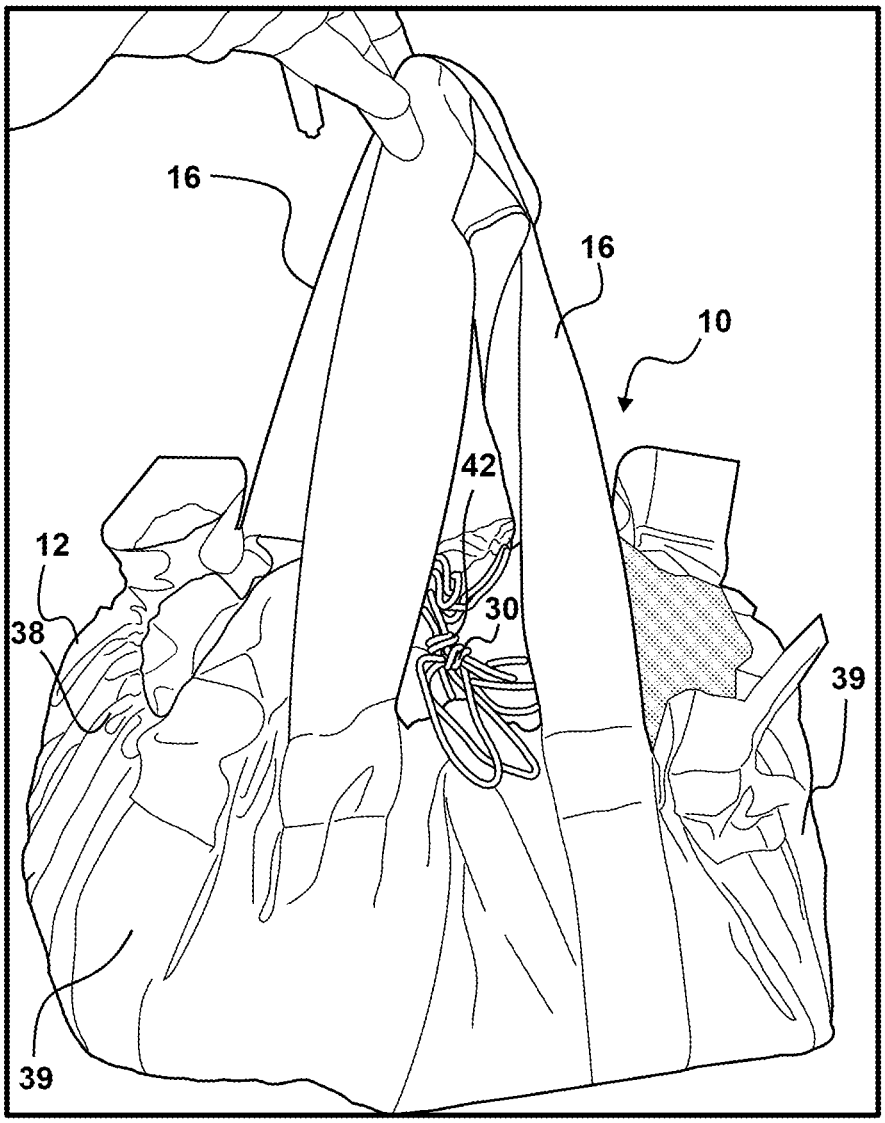
FIG. 5 shows the body of the bag device changed from the first position to a bag configuration, with sidewalls formed by the accordion fold or pleats by a pulling of projecting portions of the flexible member which forms an interior cavity, and an engagement of the two projecting portions to each other to maintain the formed bag.

Finally shown in FIG. 5 is the second configuration of the body 12 to form a bag, subsequent to the pulling the projecting portions 30 and a portion of the flexible member 18, out of confinement in the channels 17. As noted, this shortens the flexible member 18 along the pathways formed by the channels 17 and diagonal sections 26, and causes an accordion fold 38 to form around all four edges of the body 12. The accordion fold 38 causes a sidewall 39 to be formed around the perimeter edge of the body 12. Concurrently an interior cavity 40 is formed within the sidewall 39 of the formed bag.

As further shown in FIG. 5, the projecting portions 30 and the flexible member 18 pulled from the channels 17, may be knotted together, or have a connector 42 (FIG. 2) engaged therebetween, which temporarily prevents retraction of the flexible member 18 back into the channels 17. This maintains the body 12 in a bag configuration until the connector 42 or knots or other securements are released whereupon the length of the flexible member 18 is allowed to slide back into the channels 17 and across the diagonal sections 26.

While all of the fundamental characteristics and features of the self configuring bag device have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are considered included within the scope of the invention as defined by the following claims.

What is claimed is:

1. A self-configuring bag apparatus, comprising:

a flexible body having a shape defined by a perimeter edge thereof;

said body being planar and having a first surface opposite a second surface;

said body positionable to a first position, with said first surface located upon a support surface;

a channel formed around said perimeter edge of said body;

a flexible member slidably engaged within said channel;

a first opening communicating between said channel and said second surface, said first opening positioned on a first side of said body;

a second opening communicating between said channel and said second surface, said second opening positioned on a second side of said body, opposite said first opening;

a first projecting portion of said flexible member, extending from said first opening;

a second projecting portion of said flexible member, extending from said second opening;

said body reconfigurable from said first position to a bag configuration by a pulling of said first projecting portion and said second projecting portion to shorten a length of said flexible member positioned within said channel;

said body in said bag configuration having a sidewall surrounding a central portion of said second surface;

said channel positioned between a first flexible layer opposite a second flexible layer;

a flexible central layer positioned in-between said first flexible layer and said second flexible layer;

a first interior opening communicating through said flexible central layer at a first position aligned with said first opening;

a second interior opening communicating through said flexible central layer at a second position aligned with said second opening;

said first projecting portion communicating through both, said first interior opening and said first opening aligned therewith;

said second projecting portion communicating through both said second interior opening and said opening aligned therewith; and an interior cavity defined by an area between said sidewall and said central portion of said second surface, said interior cavity configured to hold objects therein.

2. The self-configuring bag apparatus of claim 1, additionally comprising:

a first handle, said first handle having a first end thereof connected to said body and having a second end thereof connected to said body;

said first opening being located in-between said first end of said first handle and said second end of said first handle;

a second handle, said second handle having a first end thereof connected to said body and having a second end thereof connected to said body; and said second opening being located in-between said first end of said second handle and said second end of said second handle.

3. The self-configuring bag apparatus of claim 1, additionally comprising:

a first portion of said channel running along said first side of said body;

a second portion of said channel running along said second side of said body;

a third portion of said channel running along a third side of said body between said first side of said body and said second side of said body;

a fourth portion of said channel running along a fourth side of said body opposite said third portion of said channel;

said flexible member communicating in a first diagonal section, between said first portion of said channel and said third portion of said channel;

said flexible member communicating in a second diagonal section between said third portion of said channel and said second portion of said channel;

said flexible member communicating in a third diagonal section between said second portion of said channel and said fourth portion of said channel; and said flexible member communicating in a fourth diagonal section between said fourth portion of said channel and said first portion of said channel.

4. The self-configuring bag apparatus of claim 2, additionally comprising:

a first portion of said channel running along said first side of said body;

a second portion of said channel running along said second side of said body;

a third portion of said channel running along a third side of said body between said first side of said body and said second side of said body;

a fourth portion of said channel running along a fourth side of said body opposite said third portion of said channel;

said flexible member communicating in a first diagonal section, between said first portion of said channel and said third portion of said channel;

said flexible member communicating in a second diagonal section between said third portion of said channel and said second portion of said channel;

said flexible member communicating in a third diagonal section between said second portion of said channel and said fourth portion of said channel; and said flexible member communicating in a fourth diagonal section between said fourth portion of said channel and said first portion of said channel.

5. The self-configuring bag apparatus of claim 2, additionally comprising:

a first restraint engaged to said first projecting portion, said first restraint having a cross section which is larger than a diameter of said first opening; and a second restraint engaged to said second projecting portion, said second restraint having a cross section which is larger than a diameter of said second opening.

6. The self-configuring bag apparatus of claim 3, additionally comprising:

a first restraint engaged to said first projecting portion, said first restraint having a cross section which is larger than a diameter of said first opening; and a second restraint engaged to said second projecting portion, said second restraint having a cross section which is larger than a diameter of said second opening.

7. The self-configuring bag apparatus of claim 4, additionally comprising:

a first restraint engaged to said first projecting portion, said first restraint having a cross section which is larger than a diameter of said first opening; and a second restraint engaged to said second projecting portion, said second restraint having a cross section which is larger than a diameter of said second opening.

* * * * *